US009433811B1

(12) United States Patent
Mohammad

(10) Patent No.: US 9,433,811 B1
(45) Date of Patent: Sep. 6, 2016

(54) PORTABLE FIRE PROTECTION SYSTEM

(71) Applicant: Mousa A. Mohammad, Safat (KW)

(72) Inventor: Mousa A. Mohammad, Safat (KW)

( * ) Notice: Subject to any disclaimer, the term of this patent is extended or adjusted under 35 U.S.C. 154(b) by 0 days.

(21) Appl. No.: 14/877,903

(22) Filed: Oct. 7, 2015

(51) Int. Cl.

| | |
|---|---|
| ***A62C 25/00*** | (2006.01) |
| ***A62C 35/64*** | (2006.01) |
| ***A62C 35/02*** | (2006.01) |
| ***A62C 37/38*** | (2006.01) |
| ***B05B 15/10*** | (2006.01) |

(52) U.S. Cl.
CPC ..... *A62C 35/64* (2013.01); *A62C 25/00* (2013.01); *A62C 35/026* (2013.01); *A62C 37/38* (2013.01); *B05B 15/10* (2013.01)

(58) Field of Classification Search
CPC .... A62C 25/00; A62C 25/005; A62C 11/00; A62C 13/78; A62C 37/38; A62C 35/026; B05B 15/10
USPC ..... 169/13, 16, 52
See application file for complete search history.

(56) References Cited

U.S. PATENT DOCUMENTS

| | | | | |
|---|---|---|---|---|
| 584,804 | A * | 6/1897 | Winton | F16L 3/00 239/280.5 |
| 3,713,491 | A | 1/1973 | Grabowski et al. | |
| 3,866,687 | A | 2/1975 | Banner | |
| 4,819,732 | A | 4/1989 | Laumeister | |
| 6,719,065 | B2 | 4/2004 | Baughman | |
| 2002/0189824 | A1 | 12/2002 | Joseph | |
| 2008/0257566 | A1 * | 10/2008 | Shattuck | A62C 13/64 169/46 |
| 2008/0271903 | A1 | 11/2008 | Lindstrom et al. | |
| 2011/0094761 | A1 | 4/2011 | Bollens | |

FOREIGN PATENT DOCUMENTS

| | | |
|---|---|---|
| GB | 2248018 | 3/1992 |
| KR | 20100084952 | 7/2010 |

OTHER PUBLICATIONS

Website, http://fire-fighting101.en.made-in-china.com/product/QgXJxpOHVfDR/ China-Pump-Med . . . , Pump Medium Pressure Water Mist Fire Extinguishing Systems (ZSXZB), two pages printed from the Internet on Apr. 21, 2015.
Website, http://www.watermist.com/en/products/compact-pump-unit/, Hydramist Compact Pump Unit, three pages printed from the internet on Apr. 21, 2015.
Website, http://www.watermist.com/en/products/mobile-8/, Mobile 8, three pages printed from the internet on Apr. 21, 2015.

* cited by examiner

*Primary Examiner* — Jason Boeckmann
(74) *Attorney, Agent, or Firm* — Richard C. Litman

(57) ABSTRACT

The portable fire protection system comprises a self-contained apparatus including a quantity of fire extinguishing agent, a pump, a pop-up sprinkler head, a power supply, and a receiver. A remotely located smoke and fire detector communicates wirelessly with the receiver to actuate the apparatus in the event that smoke and/or fire is detected. The extinguishing agent is dispensed from the tank by the pump and the pop-up sprinkler head, with the head automatically deploying when water pressure is provided thereto by the pump. The low pressure sprinkler head dispenses a wide array of various sizes of droplets when the system is activated.

10 Claims, 4 Drawing Sheets

PORTABLE FIRE PROTECTION SYSTEM

BACKGROUND OF THE INVENTION

1. Field of the Invention

The present invention relates generally to fire protection systems, and particularly to a portable fire protection system having a self-contained supply of water or other fire extinguishing agent and a self-contained operating system, actuated by a remote wireless detector.

2. Description of the Related Art

Fire suppression or protection systems are required by law in many, if not most, public access structures, homes for the physically and mentally infirm, hospitals, schools, day care centers, and other such facilities. It is well known that the fire protection networks of detection systems and devices, water pipes, sprinkler heads, and other related components are generally quite costly, but the potential benefit and legal requirements outweigh the cost of installation and maintenance of such systems.

People are well advised to install similar systems in their own homes or private residences, as well. However, this is generally not done due to the expense of such systems. Rather, people will rely upon one or two smoke detectors located at various places in the residence, and perhaps one or two hand held fire extinguishers. While the smoke detectors may provide sufficient warning for the occupants of the residence, it may be that they are unable to access a portable fire extinguisher when needed. Moreover, many private residences have one or more very small children or infants and/or older adults of limited mobility. A mere smoke detector and hand held fire extinguisher may be insufficient protection against a fire in the residence, and may not provide sufficient time for some people in the residence to escape or to be rescued.

Accordingly, various portable fire protection and extinguishing devices and systems have been developed in the past, e.g., the hand held fire extinguishers noted above. Another example is found in Korean Patent Publication No. 20100084952 published on Jul. 28, 2007 to Byeong Su Min. This reference describes (according to the drawings and English abstract) a system having a wall-mounted fire sprinkler nozzle aimed to spray water on the interior ceiling of the structure in which it is installed.

Thus, a portable fire protection system solving the aforementioned problems is desired.

SUMMARY OF THE INVENTION

The portable fire protection system essentially comprises a housing containing a supply of water or other fire extinguishing agent and an operating system for dispensing the water or agent when the device is activated. The housing is mounted on casters or other wheels to facilitate positioning the device as desired in a structure or elsewhere. The housing includes a tank for water or other extinguishing agent, with a low pressure pump providing extinguishing agent to a sprinkler head. The housing also includes an electrical storage battery for operation of the pump independent of external electrical power. However, a battery charger is also provided, with the charger receiving electrical power from a conventional external electrical source as needed to maintain battery charge.

A pop-up sprinkler head is provided atop the housing, with a guard or support structure extending upward from the top of the housing and generally surrounding the sprinkler head. The sprinkler head is normally retracted when the system is inactive, but extends automatically to spray water or other extinguishing agent in a predetermined pattern when the pump is activated. The relatively low pressure of the pump and sprinkler head combination results in an array of variably sized water droplets, with larger droplets removing heat and drowning the fire and smaller droplets serving to cool the air. The system is activated by a remotely disposed, wireless smoke and/or fire detection device, with the housing having a receiver therein to receive a signal(s) from the detector.

The system is relatively compact, with the greater portion of the volume of the device being taken up by the tank or container therein for the extinguishing agent. The compact configuration of the system permits it to be stored or disguised within an overlying cabinet or other article of furniture, for an unobtrusive appearance when placed in a room in a residence or other structure. The device may include one or more automatically activated lights when the system is activated by the detector.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
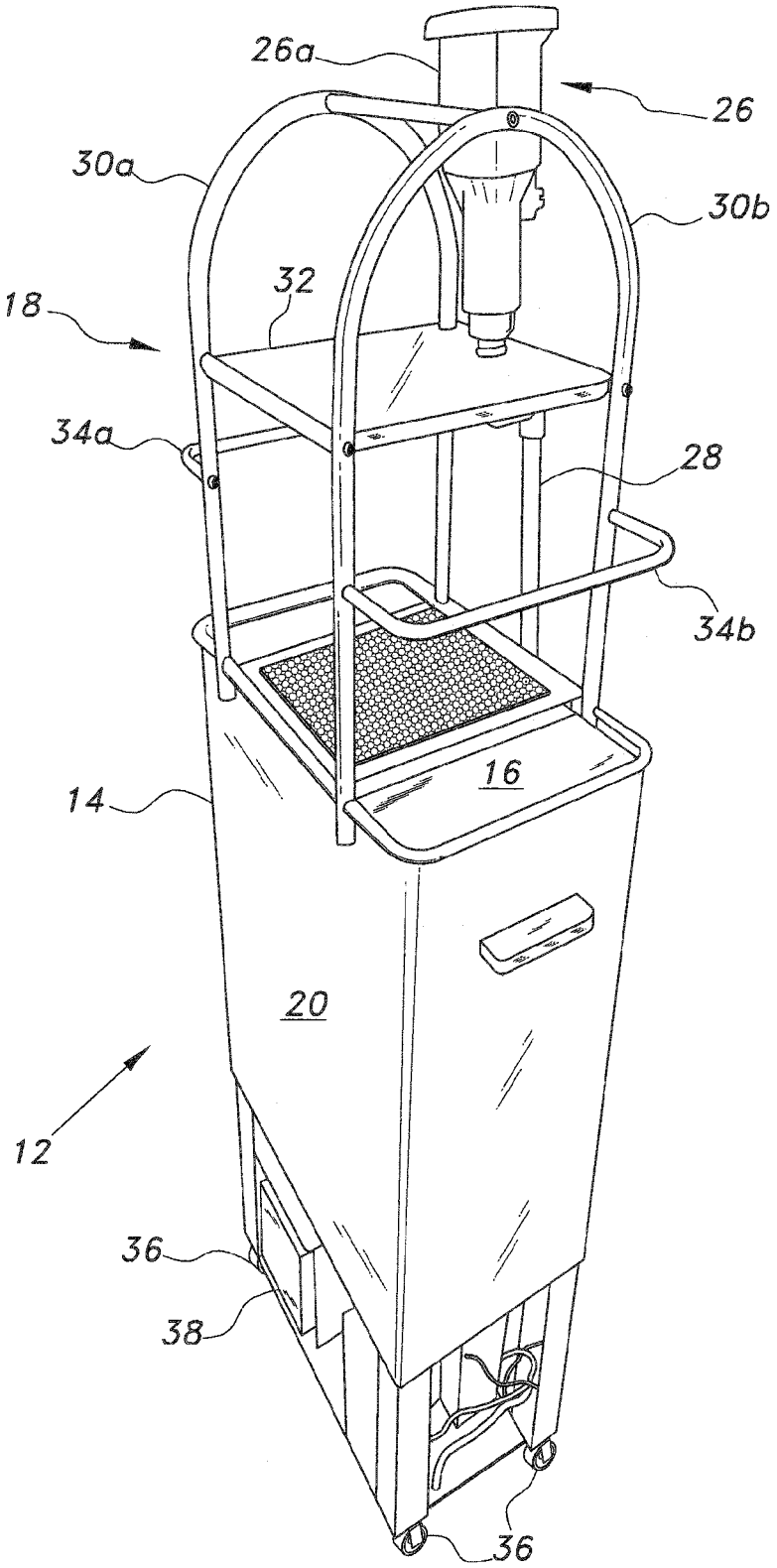
FIG. 1 is a front perspective view of a portable fire protection system according to the present invention, illustrating its general configuration and features.

The portable fire protection system comprises a self-contained apparatus 12 including a quantity of fire extinguishing agent, a pump, a pop-up sprinkler head, a power supply, and a receiver. A remotely located smoke and fire detector communicates wirelessly with the receiver to actuate the apparatus in the event that smoke and/or fire is detected. The entire system including the apparatus and the remotely located detector is illustrated in the block diagram of FIG. 4, and designated by the reference numeral 10. The apparatus 12, excluding the remotely situated detector, may be concealed within a cabinet or other decorative cover to provide an unobtrusive appearance.

FIG. 1 of the drawings is a front perspective view illustrating the basic structure of the apparatus 12 of the system. The apparatus 12 includes a housing 14 having a top 16, with a superstructure 18 extending upward from the top 16. The portion of the housing 14 immediately below the top 16 may comprise a relatively large tank 20 for the containment of a fire extinguishing agent, e.g., water, or other suitable extinguishing agent.

Figure 2:
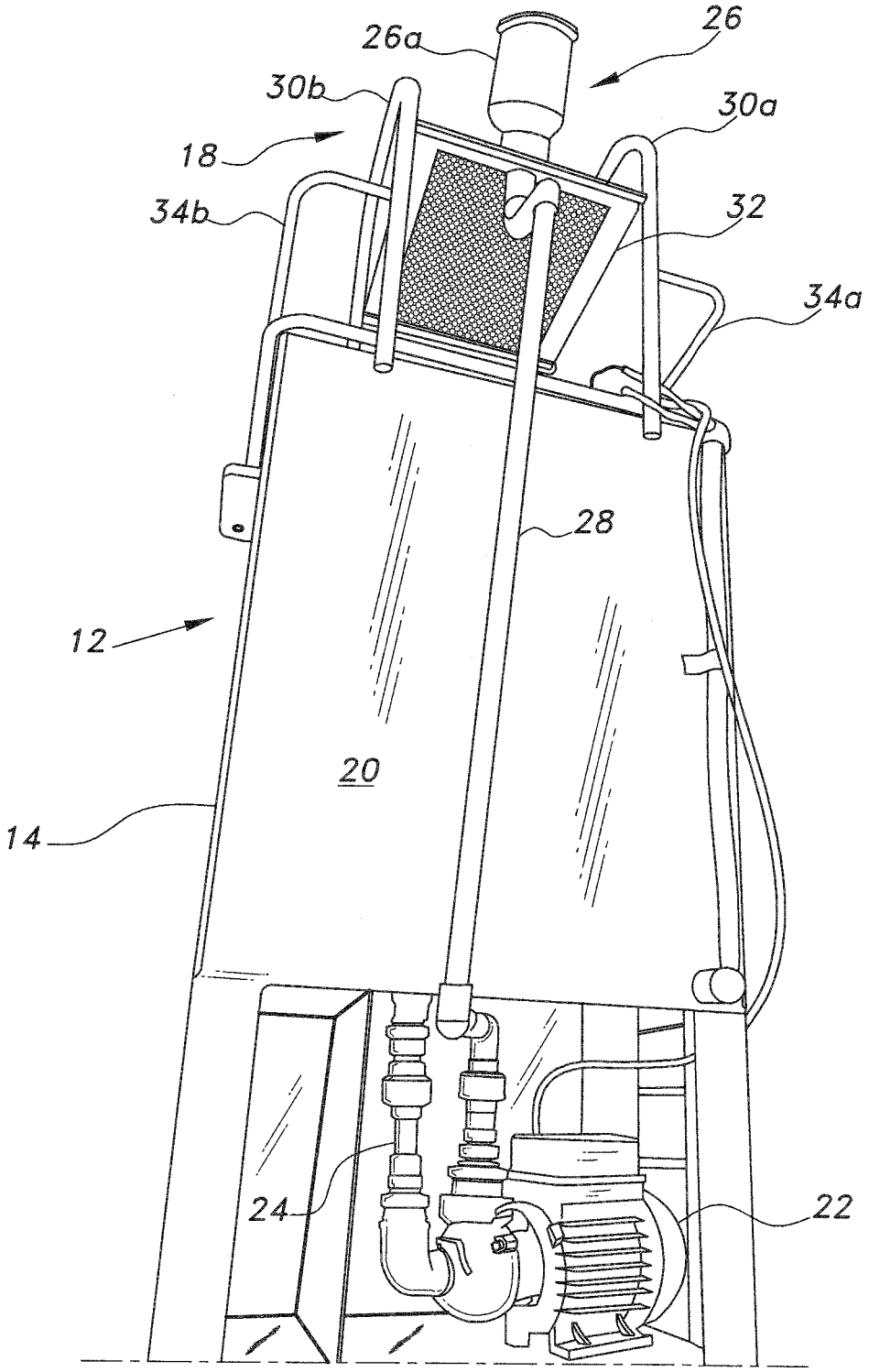
FIG. 2 is a rear perspective view of the portable fire protection system according to the present invention, illustrating further features thereof.

FIG. 2 provides a rear perspective view of the apparatus 12, illustrating additional components and features. The base of the housing 14 includes a low pressure pump 22, providing a relatively high volume of water or other fire extinguishing agent at relatively low pressure, i.e., about that provided by a conventional water supply utility. The pump 22 communicates with the tank 20 via a feed pipe 24 extending from the bottom of the tank 20 to the pump 22.

Figure 3B:
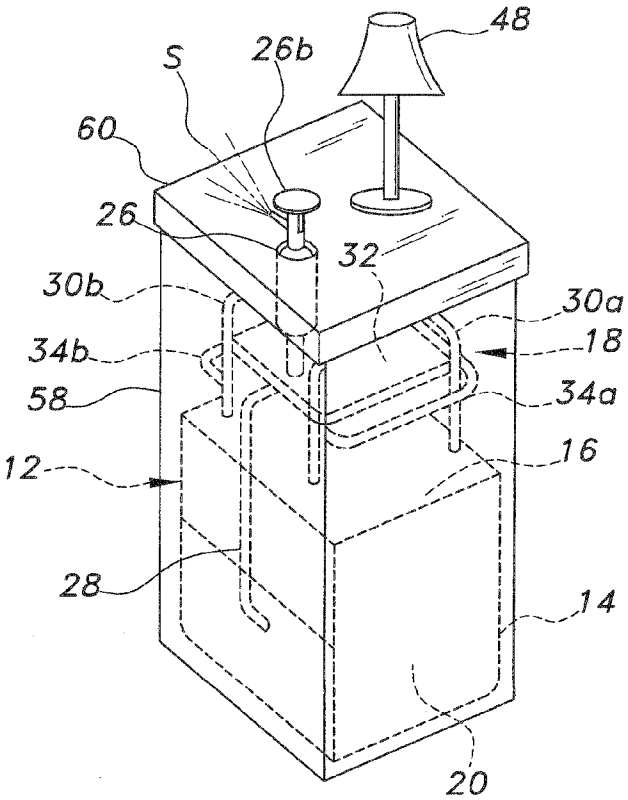
FIG. 3B is an environmental perspective view of the portable fire protection system according to the present invention, showing the activated system enclosed in an outer cabinet.
Figure 3A:
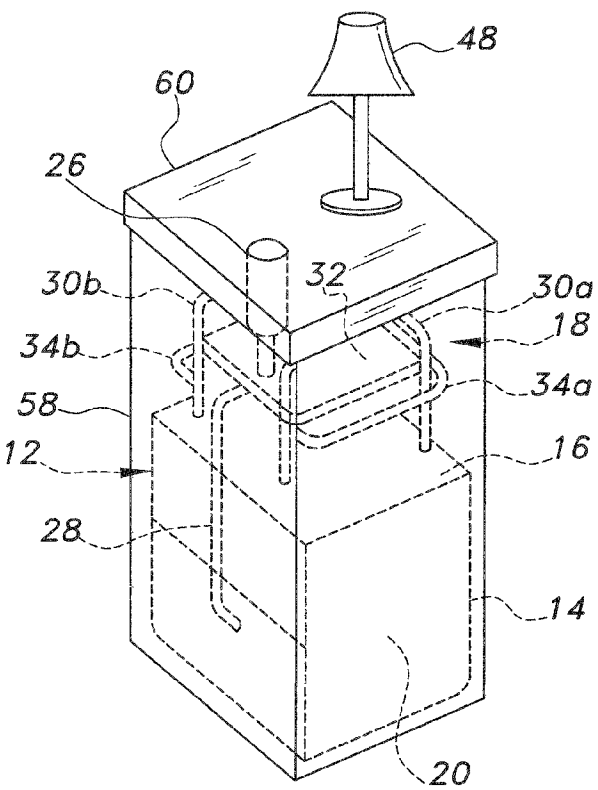
FIG. 3A is an environmental perspective view of the portable fire protection system according to the present invention, showing the inactive system enclosed in an outer cabinet.

The pump 22 supplies fire extinguishing agent to an automatically deployed, pop-up type sprinkler head 26 situated in the superstructure 18 via a supply pipe 28. The sprinkler head 26 comprises an outer shell 26*a* containing a pop-up sprinkler unit 26*b*. The pop-up unit 26*b* is normally concealed within the outer shell 26*a*, as shown in FIGS. 1, 2, and 3A. When water pressure is delivered to the sprinkler head 26 by the pump 22 and supply pipe 28, the pressure extends the pop-up unit 26*b*, generally as shown in FIG. 3B. The pop-up unit 26*b* is preferably an impact rotor type, i.e., having one or more spring-biased weights that are impacted by the directional water spray during operation. This serves to break up the spray into innumerable droplets of various sizes, as is known in the art, with the impact of the water stream also serving to shift the orientation of the pop-up unit 26*b* incrementally about a circular path to ensure complete saturation of the immediately surrounding area. Such pop-up impact rotor sprinkler heads having such features are known in the art, with examples being manufactured by the Rain Bird Company as models AG-5 and LG-3. Other models and brands having similar features may be used with the system 10 of the present invention.

The superstructure 18 of the apparatus comprises mutually parallel, first and second arched members 30*a* and 30*b* that extend from the top 16 of the housing 14. An intermediate sprinkler head mounting plate 32 is installed in the superstructure 18, above the top 16 of the housing 14 and between the arched members 30*a* and 30*b*. This provides a solid, rigid mounting plate to which the base of the sprinkler head 26 is attached to extend upward above the mounting plate 32. Additional lateral members 34*a* and 34*b* may be provided, to serve as handles to facilitate movement of the apparatus 12 and/or to assist in holding a non-rigid cover clear of the upper portion of the apparatus 12. Casters, wheels, or rollers 36 (FIG. 1) may be provided beneath the housing 12 to facilitate movement or repositioning of the apparatus 12 as desired.

Figure 4:
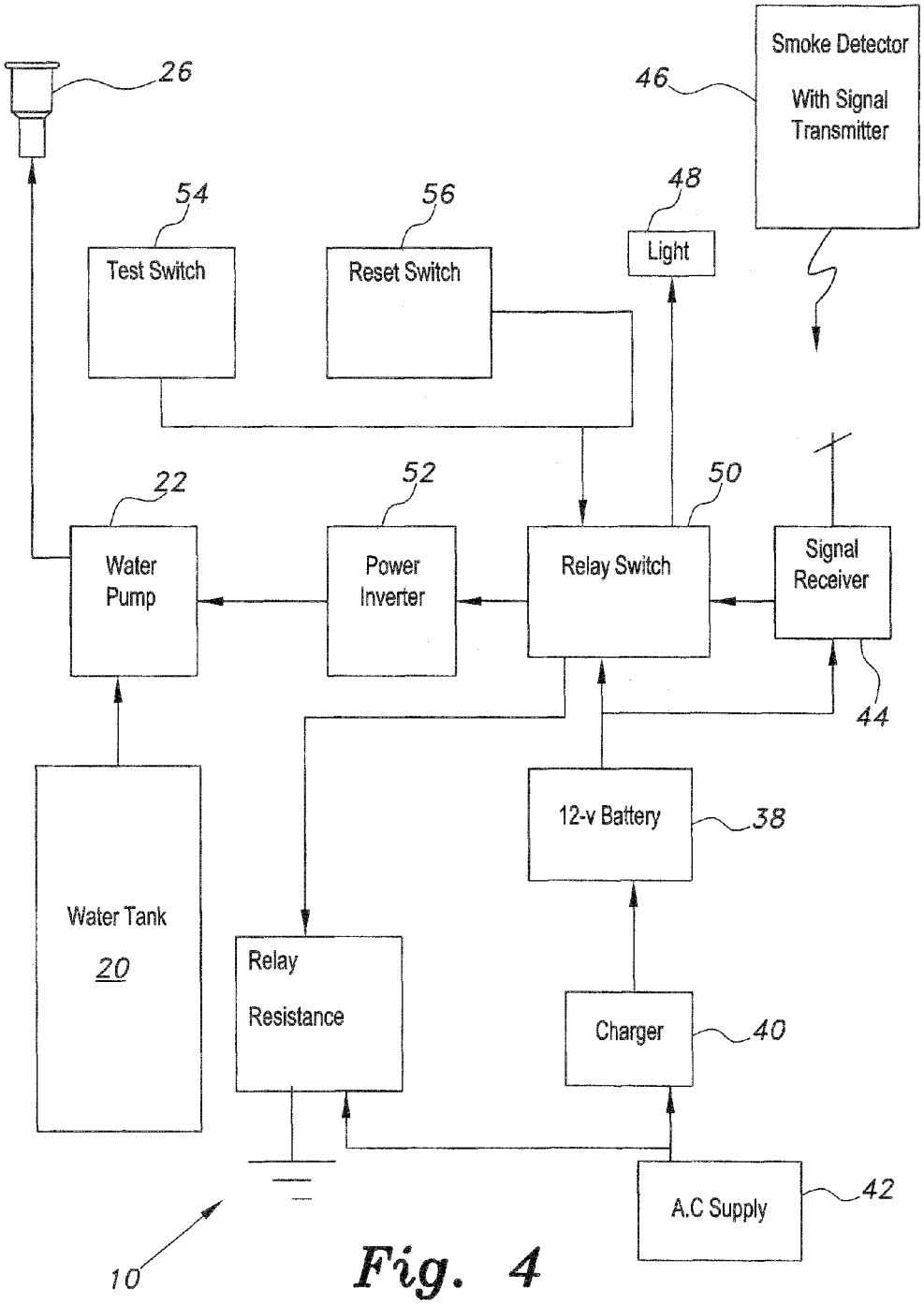
FIG. 4 is a block diagram of the portable fire protection system according to the present invention, illustrating its basic components and their relationships to one another.

FIG. 4 provides a block diagram describing the basic electrical and mechanical components of the system 10. Electrical power for the fire extinguishing agent pump 22 is primarily provided by an electrical storage battery 38 installed in the base of the housing 14 below the fire extinguishing agent tank 20, with the battery 38 being partially shown in FIG. 1 as well. The battery 38 is of sufficient electrical capacity to operate the pump 22 and other electrical components for at least several minutes, and may comprise a standard automotive battery or the like of sufficient capacity. The battery 38 may be periodically recharged by a battery charger 40 installed in the base of the housing 14, with the charger 40 receiving electrical power from a conventional AC electrical source 42.

The electrical storage battery 38 also provides electrical power to the wireless receiver 44 installed with the housing 14. The receiver 44 is set to receive signals (RF, IR, etc.) from a smoke and/or flame detector 46 situated remotely, but within operating distance, of the apparatus 12 and its receiver 44. The detector 46 includes a conventional transmitter that is actuated simultaneously with actuation of the detector 46 when sufficient smoke and/or flame is detected. The transmitter sends a signal to the receiver 44, with the receiver 44 actuating the pump 22 (and optionally a light 48) via appropriate relays, e.g., relay 50, and/or other circuitry as required. If the pump 22 operates on alternating electrical current, an inverter 52 is provided in the power circuit to the pump 22. Normally open, momentary contact test and reset switches, respectively 54 and 56, are provided with the housing 14, e.g., in a panel adjacent to other electrical circuitry disposed below the tank 20 in the apparatus 12.

FIGS. 3A and 3B provide environmental perspective views of the apparatus 12 in standby mode (FIG. 3A) and in operating mode (FIG. 3B). In both FIGS. 3A and 3B, the apparatus 12 has been concealed in a cabinet 58 or other unobtrusive structure in order to conceal the apparatus. The cabinet or structure 58 may have any appearance as desired, e.g., the rectangular storage cabinet shown in FIGS. 3A and 3B, or other article of furniture or the like as desired. The top panel 60 of the cabinet or structure 58 includes a passage therethrough for the top of the sprinkler head 26, with the vertical dimensions of the components preferably being adjusted such that the top of the sprinkler head 26 is flush with the upper surface of the top panel 60 of the cabinet 60. Thus, the top of the sprinkler head 26 may resemble a conventional coaster or the like for the placement of beverage containers thereon, in order to further camouflage the apparatus 12. The light 48 may comprise a lamp or the like of conventional appearance, as shown in FIGS. 3A and 3B, further concealing the apparatus 12 therebelow. Other lighting may be provided in lieu of or in addition to the lamp 48, and/or remotely located lights may be connected to the system to be activated when the receiver 44 detects a signal from the detector 46.

In FIG. 3B, the pop-up unit 26*b* of the sprinkler head 25 is shown raised above the top panel 60 of the cabinet or other concealing structure 58, as results when the receiver 44 (FIG. 4) detects a signal and closes the relay 50 to actuate the pump 22. The water (or other fire extinguishing agent) pressure provided by the pump 22 causes the retracted unit 26*b* to pop up, with water (or other agent) being emitted as a spray S of variously sized droplets as the unit 26*b* rotates due to the action of the impact rotor. The result is a thorough wetting down of the area in the vicinity of the smoke and/or fire, and quenching of any fire in the area.

It is to be understood that the present invention is not limited to the embodiments described above, but encompasses any and all embodiments within the scope of the following claims.

I claim:

1. A portable fire protection system, comprising:

a housing having a top;

a light disposed with the housing;

a superstructure consisting of:

a pair of spaced, upright members, the superstructure extending above the top;

a sprinkler head mounting plate disposed above the top of the housing and between the spaced, upright members;

wherein the pair of spaced, upright members are mutually parallel, first and second arched tubular members extending upward from the housing top; and a concealing structure removably disposed over the superstructure and the housing;

a fire extinguishing agent tank disposed in the housing;

a pump disposed in the housing, the pump communicating with the tank;

an automatically deployed, pop-up sprinkler head attached to the superstructure of the housing, the sprinkler head communicating with the pump, the sprinkler head automatically extending when fluid pressure is provided thereto by the pump, the sprinkler head incrementally changing direction of spray emitted therefrom during operation;

wherein the sprinkler head is installed on the sprinkler head mounting plate, the sprinkler head extending upwardly on demand therefrom;

a wireless signal receiver disposed in the housing, the receiver communicating with the pump, the receiver activating the pump when an external signal is received; and an electrical storage battery disposed within the housing, the battery providing electrical power to at least the pump and the receiver as required.

2. The portable fire protection system according to claim 1, wherein the sprinkler head is a low pressure unit and includes one or more spring-biased weights for breaking up the spray of extinguishing agent from the sprinkler head into an array of droplets varying in size from one another when activated.

3. The portable fire protection system according to claim 1, further comprising a plurality of wheels disposed beneath the housing.

4. The portable fire protection system according to claim 1, further comprising a remotely disposed smoke and/or fire detector, the detector communicating wirelessly with the wireless signal receiver disposed in the housing.

5. A portable fire protection system, comprising:

a housing having a top;

a superstructure including spaced, upright members, the superstructure extending above the top;

a sprinkler head mounting plate disposed above the top of the housing and between the spaced, upright members, the sprinkler head installed upon the sprinkler head mounting plate and extending upward therefrom, wherein the spaced, upright members include mutually parallel, first and second arched tubular members extending upward from the housing top;

a fire extinguishing agent tank disposed in the housing;

a low pressure pump disposed in the housing, the pump communicating with the tank;

a low pressure sprinkler head attached to the superstructure of the housing, the sprinkler head communicating with the pump, the sprinkler head automatically activating when fluid pressure is provided thereto by the pump, the sprinkler head including one or more spring-biased weights for breaking up the spray of extinguishing agent from the sprinkler head into an array of droplets varying in size from one another when activated;

a wireless signal receiver disposed in the housing, the receiver communicating with the pump, the receiver activating the pump when an external signal is received;

an electrical storage battery disposed within the housing, the battery providing electrical power to at least the pump and the receiver as required; and a remotely disposed smoke and/or fire detector, the detector communicating wirelessly with the wireless signal receiver disposed in the housing;

wherein the sprinkler head is an automatically deployed, pop-up unit, the sprinkler head automatically extending when fluid pressure is provided thereto by the pump, the sprinkler head incrementally changing direction of spray emitted therefrom during operation.

6. The portable fire protection system according to claim 5, further comprising a plurality of wheels disposed beneath the housing.

7. The portable fire protection system according to claim 5, further comprising a concealing structure removably disposed over the housing.

8. The portable fire protection system according to claim 5, further comprising a light disposed with the housing.

9. A portable fire protection system, consisting of:

a housing having a top;

a superstructure extending above the top of the housing, the superstructure comprising;

mutually parallel, first and second arched tubular members extending upward from the top;

a sprinkler head mounting plate disposed above the top of the housing and between the arched tubular members;

a fire extinguishing agent tank disposed in the housing;

a pump disposed in the housing, the pump communicating with the tank;

an automatically deployed low pressure sprinkler head, including one or more spring-biased weights for breaking up a spray of extinguishing agent from the low pressure sprinkler head into an array of droplets varying in size from one another upon activation, the low pressure sprinkler head being installed upon the sprinkler head mounting plate and extending upward therefrom, the sprinkler head communicating with the pump;

wherein the pump moves the extinguishing agent from the tank to the low pressure sprinkler head;

a wireless signal receiver disposed in the housing, the receiver communicating with the pump, the receiver activating the pump when an external signal is received;

a remotely disposed, wireless smoke and/or fire detector, communicating wirelessly with the receiver;

an electrical storage battery disposed within the housing, the battery providing electrical power to at least the pump and the receiver as required;

a light disposed with the housing;

a concealing structure removably disposed over the housing; and a plurality of wheels disposed beneath the housing.

10. The portable fire protection system according to claim 9, wherein the low pressure sprinkler head automatically extending when fluid pressure is provided thereto by the pump, the low pressure sprinkler head incrementally changing direction of spray emitted therefrom during operation.

* * * * *